US007383604B2

(12) United States Patent
Young

(10) Patent No.: US 7,383,604 B2
(45) Date of Patent: Jun. 10, 2008

(54) MOP WRINGER

(76) Inventor: Scot Young, R. R. 1, Grand Valley, Ontario, Lon Igo (CA)

( * ) Notice: Subject to any disclaimer, the term of this patent is extended or adjusted under 35 U.S.C. 154(b) by 0 days.

(21) Appl. No.: 11/324,291

(22) Filed: Jan. 4, 2006

(65) Prior Publication Data

US 2006/0143850 A1 Jul. 6, 2006

Related U.S. Application Data

(62) Division of application No. 09/876,012, filed on Jun. 8, 2001, now abandoned.

(51) Int. Cl.
*A47L 13/14* (2006.01)

(52) U.S. Cl. ..... 15/261

(58) Field of Classification Search ..... 15/260, 15/261

See application file for complete search history.

(56) References Cited

U.S. PATENT DOCUMENTS

| | | | | |
|---|---|---|---|---|
| 525,803 | A | 9/1894 | White | |
| 707,235 | A | 8/1902 | Kanel | |
| 818,722 | A | 4/1906 | Wetmore | |
| 1,234,721 | A | 7/1917 | Boggess | |
| 1,504,990 | A | 8/1924 | Stafford | |
| 1,652,800 | A | 12/1927 | Schulman | |
| 1,722,130 | A | 7/1929 | Finstad | |
| 1,831,135 | A | 11/1931 | Pehrsson | |
| 2,127,045 | A | 8/1938 | Pavek | |
| 5,070,574 | A * | 12/1991 | Delmerico et al. | 15/261 |
| 5,974,621 | A * | 11/1999 | Wilen | 15/261 |

FOREIGN PATENT DOCUMENTS

| | | |
|---|---|---|
| EP | 1232719 A2 | 8/2002 |
| FR | 648306 | 8/1928 |
| FR | 768304 | 5/1934 |
| GB | 640300 | 11/1954 |
| GB | 938608 | 10/1963 |
| GB | 10 90 194 | 4/1966 |
| GB | 2 242 825 | 10/1991 |
| GB | 2 339 144 | 1/2000 |
| GB | 2 352 165 | 1/2001 |
| IT | 499619 | 11/1954 |

* cited by examiner

*Primary Examiner*—David A. Redding
(74) *Attorney, Agent, or Firm*—Young & Thompson

(57) ABSTRACT

A mop wringer includes a base and a plurality of sides which can define a channel having a uniform or substantially uniform cross-section along its longitudinal extent, and one or more openings in the base and/or sides by which fluid can drain from the wringer. One of the sides is a pivotable guide element which is pivotable relative to the other sides on axle elements which are spaced from and which are between in use uppermost and lowermost ends of the said pivotable guide element. The in use pivotable guide element provides a wider opening for insertion of a mophead into the channel, but does not pivot to squeeze the mophead.

14 Claims, 11 Drawing Sheets

MOP WRINGER

This invention relates to a mop wringer in combination with a mophead.

BACKGROUND OF THE INVENTION

The use of mops is extremely common and widespread. A mop typically comprises a shaft or handle and a mophead engaged with one end of the shaft or handle. The body of the mophead usually supports some form of material which is designed to absorb and, at least partially, retain fluid to aid cleaning of a surface.

The fundamental problem with the absorbent material support by a mophead is that it can at times be difficult and troublesome to adequately extract enough fluid held therein to allow for a reasonable recharging of the absorbent material during further usage or in preparation for storage after use.

To attempt to overcome this problem, wringers, typically incorporating a sieve, have been developed which enable the absorbent material to be wrung or squeezed between the mophead and one or more surfaces of the wringer when the mophead is placed therein. In the case when the wringer comprises a sieve, as the mophead is manually forced downwards into the sieve, retained fluid is expelled from the absorbent material and drains out of the sieve through openings in its surfaces.

The main drawback is that a significant amount of fluid can still be retained by the absorbent material after this wringing or squeezing process. A user, therefore, typically has to perform the wringing or squeezing process more than once in order to expel an amount of fluid from the absorbent material which is sufficient for it to be worthwhile continuing the job or task in hand.

The present invention seeks to overcome this problem.

SUMMARY OF THE INVENTION

According to a first aspect of the present invention, there is provided a mop wringer comprising a base and a plurality of sides which can define a channel having a uniform or substantially uniform cross-section along its longitudinal extent, and one or more openings in the base and/or sides by which fluid can drain from the wringer, one of the said sides being a pivotable guide element which is pivotable relative to the other said sides on axle elements which are spaced from and which are between the in use uppermost and lowermost ends of the said pivotable guide element, so that the in use pivotable guide element provides a wider opening for insertion of a mophead into the channel, but does not pivot to squeeze the mophead.

According to a second aspect of the invention, there is provided a mop wringer in combination with a mophead, the wringer comprising a base and a plurality of sides which, at least in use, define a channel of rectangular transverse cross-section, and one or more openings in the base and/or sides by which fluid can drain from the wringer, and the mophead comprising a body and absorbent material supported by the body, the mophead being adapted, upon insertion into the wringer, to occlude the channel so that fluid which is discharged from the absorbent material is prevented or substantially prevented from rising above the absorbent material, wherein one of the said sides is a pivotable guide element which is pivotable relative to the other said sides on axle elements which are spaced from and which are between in use uppermost and lowermost ends of the said pivotable guide element, so that the in use pivotable guide element provides a wider opening for insertion of a mophead into the channel, but does not pivot to squeeze the mophead.

The invention will now be more particularly described, by way of example, with reference to the accompanying drawings.

DESCRIPTION OF THE PREFERRED AND ALTERNATE EMBODIMENTS

As required, a detailed description of the preferred and alternate embodiments are disclosed herein, however, other embodiments or configurations may be apparent based upon the following description to those having ordinary skill in the art.

Figure 1:
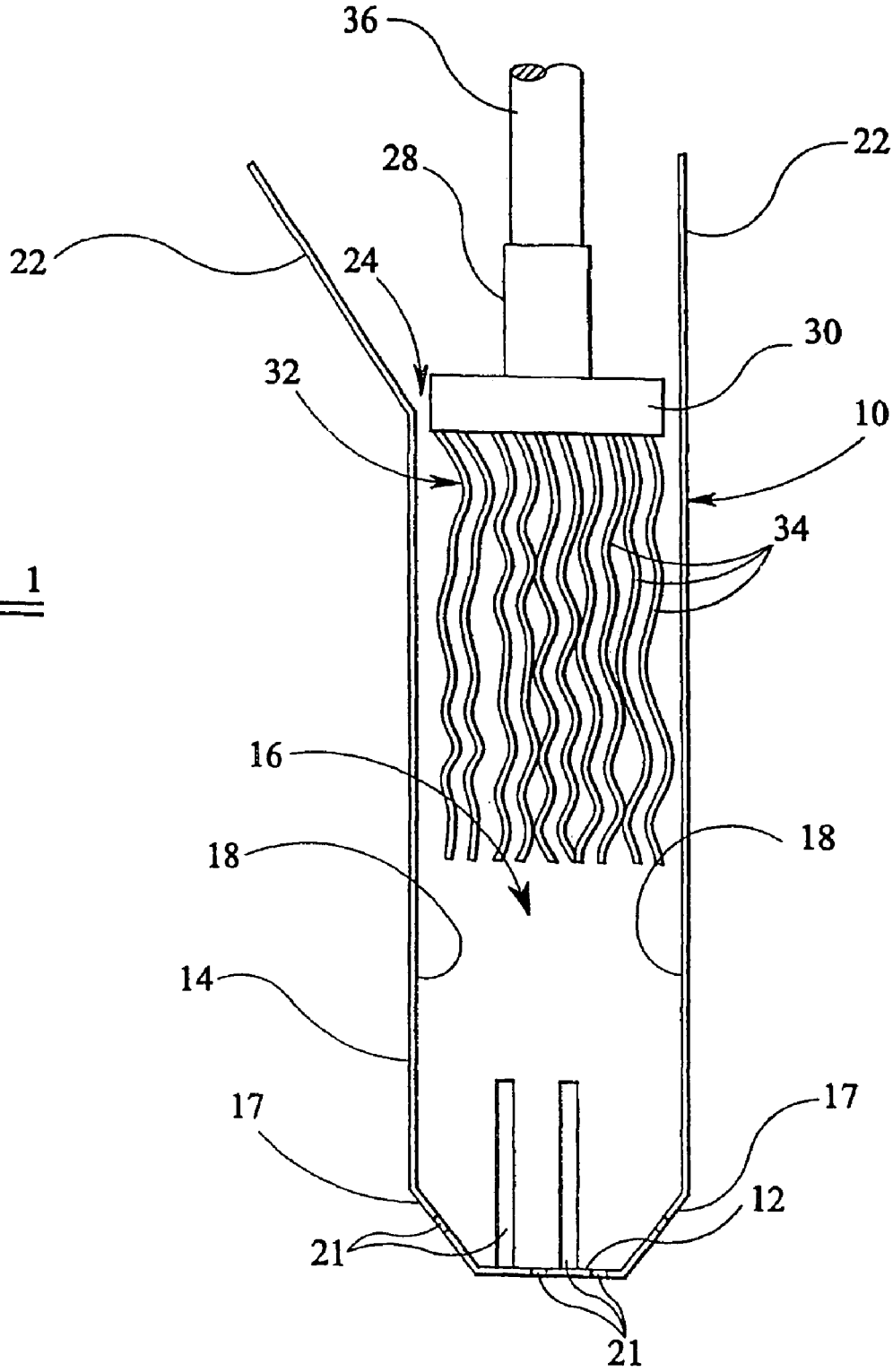
FIG. 1 is a schematic longitudinal section of a mop wringer and mophead, not in accordance with the present invention.

Referring to FIG. 1 of the drawings, a wringer 10, not in accordance with the invention is shown therein and comprises a base 12 and one or more sides 14, typically one piece moulded in fixed relationship from resilient plastic materials. The base 12 and side(s) 14 define a cylindrical or substantially cylindrical channel 16, which is of rectangular or substantially rectangular transverse cross-section, but which may be of any suitably shaped transverse cross-section.

The base 12 is perpendicular or substantially perpendicular to the depth of the channel 16 and has chamfered edges 17. However, the base 12 may be dished or of any other suitable configuration.

The inner surfaces 18 of the sides 14 are formed with a plurality of elongate ribs (not shown in FIG. 1, but referenced as 20 in FIGS. 2 to 11). The ribs 20 extend in parallel with the depth of the channel 16 and act to reinforce the structure of the channel 16.

One or more drainage holes or openings 21 are formed in the base 12 and/or sides 14. The openings 21 may be elongate, circular and/or any other suitable shape.

The wringer 10 also includes a guide portion 22, which is also typically formed from resilient plastic material. The guide portion 22 is disposed at or adjacent to the main opening 24 of the channel 16 and may be fixedly or releasably attached to the channel 16.

The wringer 10 may also have attachment means (not shown) by which the wringer 10 can be securely and/or releasably engaged with a container (not shown in FIG. 1). The attachment means prevent the wringer 10 from being lifted off the container unintentionally.

Typically, the attachment means comprise snap-fittable catches which connect the wringer 10 to the container along at least part of one or more walls of the container. This attachment means and container are of the form described in copending British patent publication number GB 2 340 738 A, and as such will not be further detailed herein.

A mophead 28 comprises a body 30 and absorbent material 32 support by the body 30. The absorbent material 32 is typically in the form of a bundle or plurality of strands 34, but may be any suitably absorbent material. The body 30 is engaged with a handle or shaft 36 and includes a clamp by which the bundle of strands 34 are clamped to the body 30. By this arrangement, at least a portion, typically peripheral, of the strands 34 tend to project outwardly or substantially outwardly beyond the sides of the body 30.

The mophead 28 is adapted to be a sliding fit in the channel 16. An average (mean clearance) between the body 30 of the mophead 28 and the inner surface 18 of the channel 16 should be less than or equal to 12 millimetres, reasons for which will become apparent hereinafter.

In use, the mophead 28 having the strands 34, which are usually charged with fluid, is inserted into the channel 16 of the wringer 10, which is typically downwardly oriented in the container. Orientation of the mophead 28 for insertion is generally accomplished with the aid of the guide portion 22.

The ribs 20 also aid the insertion of the mophead 28 as it is slid into the channel 16 by guiding the strands 34 towards the base 12. This reduces the tendency for one or more of the strands 34 to 'ball up', or to move to a position whereby the strand 34 is dragged or substantially dragged by the body 30, due to friction occurring between the strand 34 and the inner surface 18 of the channel 16.

Once the strands 34 contact the base 12 of the wringer 10, as the body 30 continues its motion, bunching or coiling up occurs as the volume between the bottom of the body 30 and the base 12 decreases. Since a gap with the aforementioned average clearance exists between the body 30 and the inner surface(s) 18, the strands 34, typically on the periphery of the bundle, will fill or substantially fill this gap as they bunch or coil up. The mophead 28, upon full or substantially full insertion, thus occludes the channel 16.

Since the channel 16 is cylindrical or substantially cylindrical, the majority of the strands 34 are able to be positioned beneath or substantially beneath the bottom surface of the body 30 and interposed or 'sandwiched' between the body 30 and the base 12. Consequently, during a squeezing or wringing operation wherein the mophead 28 is manually forced towards the base 12, the strands 34 are subjected to an even or substantially even distribution of pressure, which acts in a direction perpendicularly or substantially perpendicularly to the base 12.

The fluid expelled or discharged from the bundle of strands 34 is prevented or substantially prevented from rising above the absorbent material due to the occlusion formed by the body 30 and the peripheral strands 34 filling the said gap.

The drainage openings 21 are appropriately dimensioned to expedite the egress of fluid from the channel 16 to the container.

It is therefore apparent that the average clearance (which, as stated above, should ideally not exceed 12 millimetres) between the body 30 of the mophead 28 and each inner surface 18 of the channel 16 is critical if the gap is to be filled by the strands 34 and the discharged fluid is to be inhibited from rising above the strands 34. Discharged fluid is readily reabsorbed by the squeezed or wrung strands 34 if it rises up the channel 16 instead of draining away.

Figure 2:
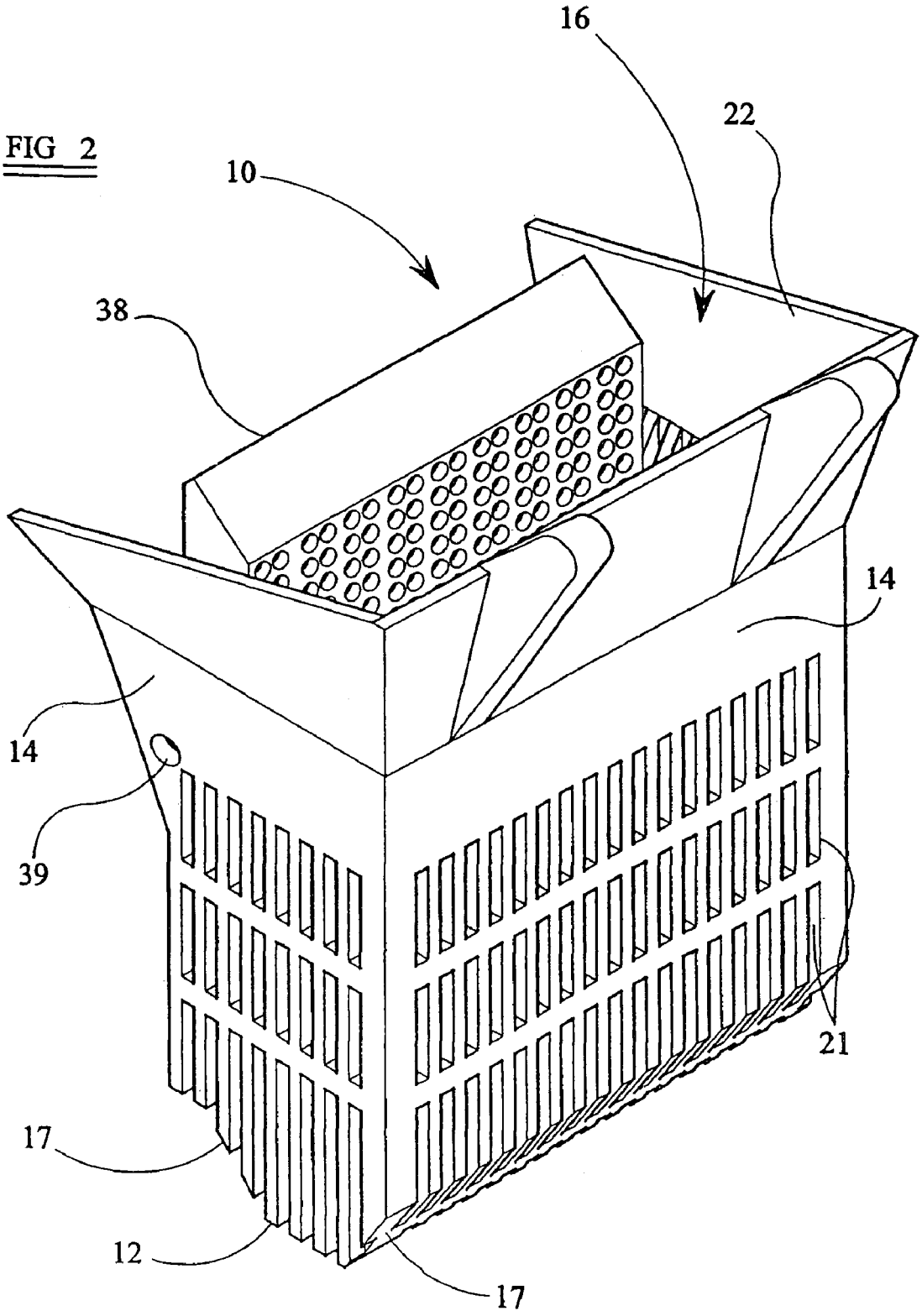
FIG. 2 is a perspective view showing a first embodiment of a mop wringer, in accordance with the present invention.
Figure 3:
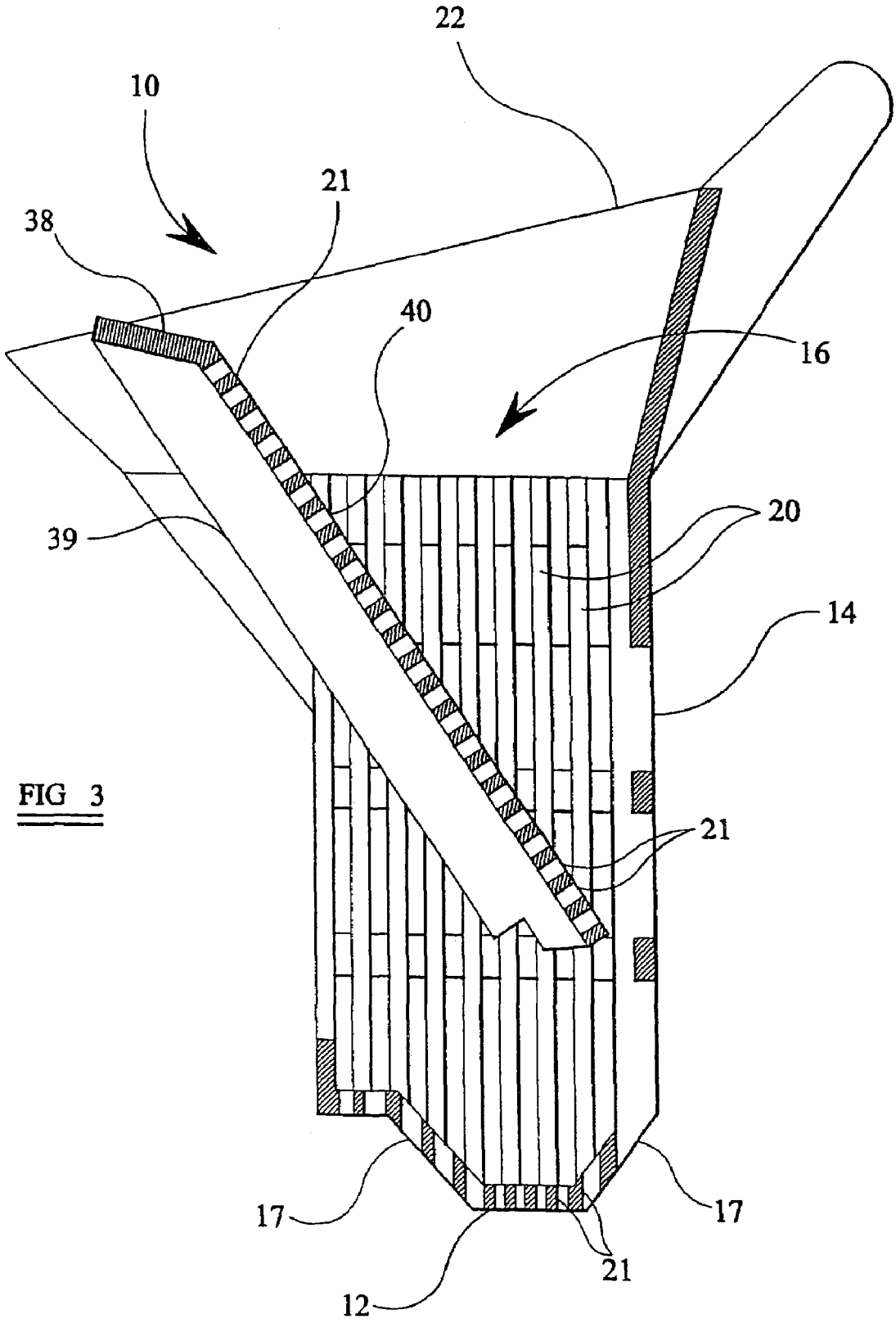
FIG. 3 is a longitudinal cross-section of the mop wringer shown in FIG. 2, when in a first condition.
Figure 4:
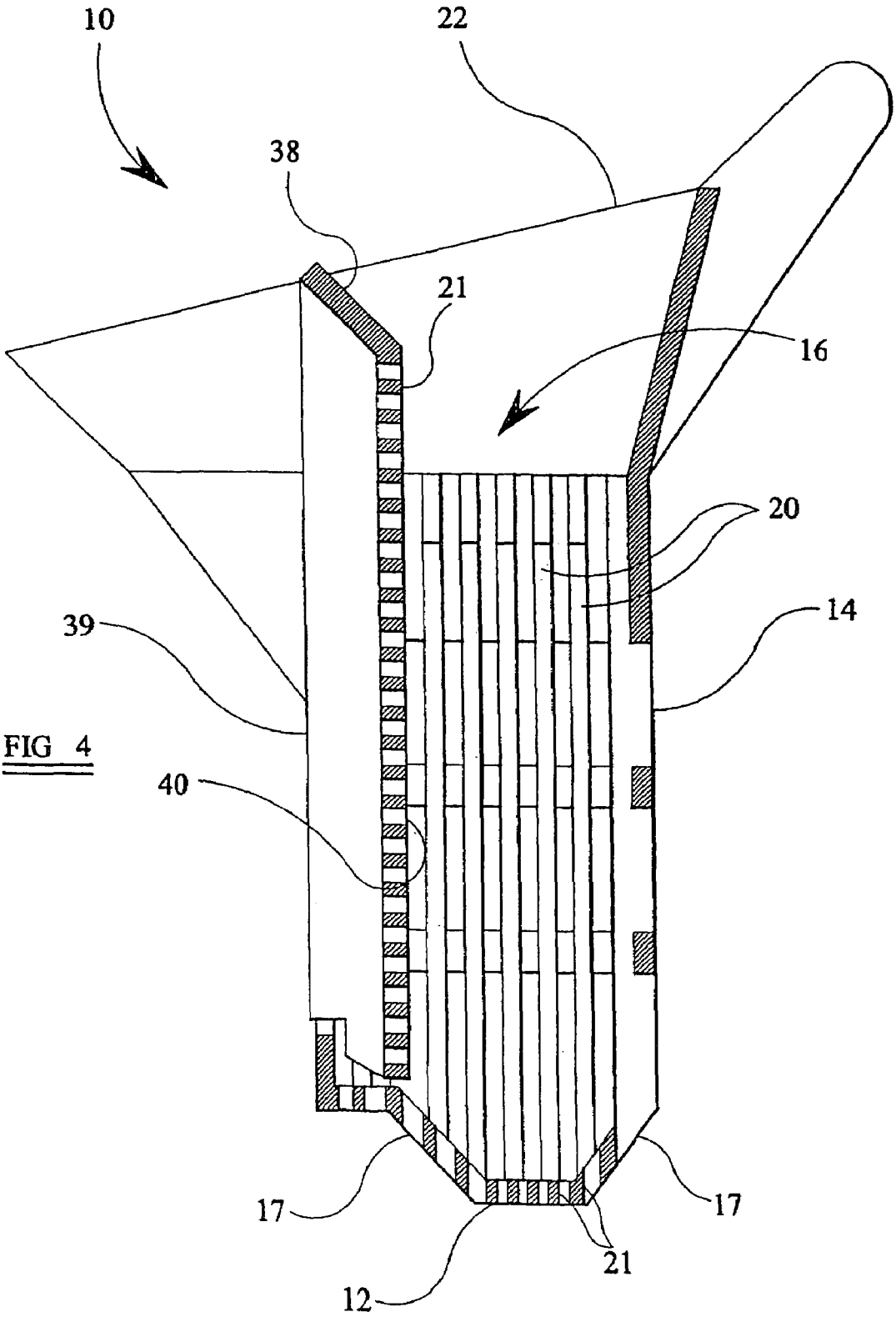
FIG. 4 is a longitudinal cross-section of the mop wringer shown in FIG. 2, when in a second condition.

In a first embodiment of the wringer 10, as shown in FIGS. 2 to 4, the guide portion 22 includes a guide element 38 which is angularly displaceable relative to the channel 16 and which replaces one of the fixed sides 14 of the wringer 10. The guide element 38 is pivotally mounted on axle elements 39 which are received in respective openings in sides 14 of the wringer 10.

The axle elements 39 are positioned nearer to the in use uppermost edge of the guide element 38, then to the lowermost edge of the guide element 38.

The use of the pivotable guide element 38 aids insertion of mopheads, especially of heavier and more unwieldy industrial type mops. As the mophead 28 (omitted in FIGS. 2 to 11) contacts a lip portion 40 of the guide element 38 (best seen in FIG. 3), the guide element 38 will tend to pivot towards the vertical (see FIG. 4), thus forming the channel 16 and enabling the mophead 28 to be easily aligned therewith. The guide element 38 also has the effect of extending the depth of the channel 16.

In this case, the ribs 20 on the inner facing surface of the guide element 38 can be dispensed with. However, the guide element 38 is provided with the drainage openings 21.

Figure 5:
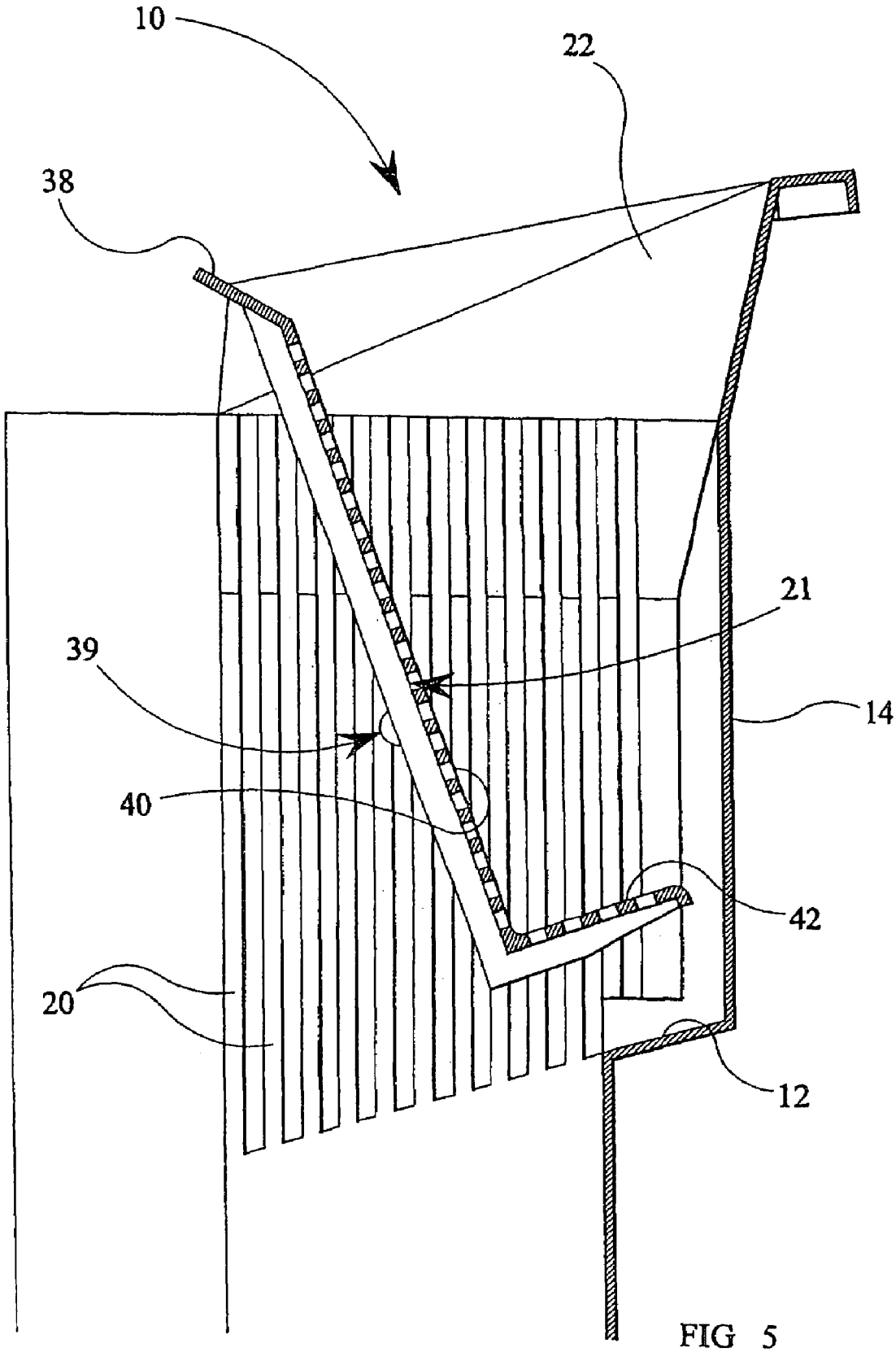
FIG. 5 is a longitudinal cross-section of a second embodiment of a mop wringer, in accordance with the present invention.
Figure 6:
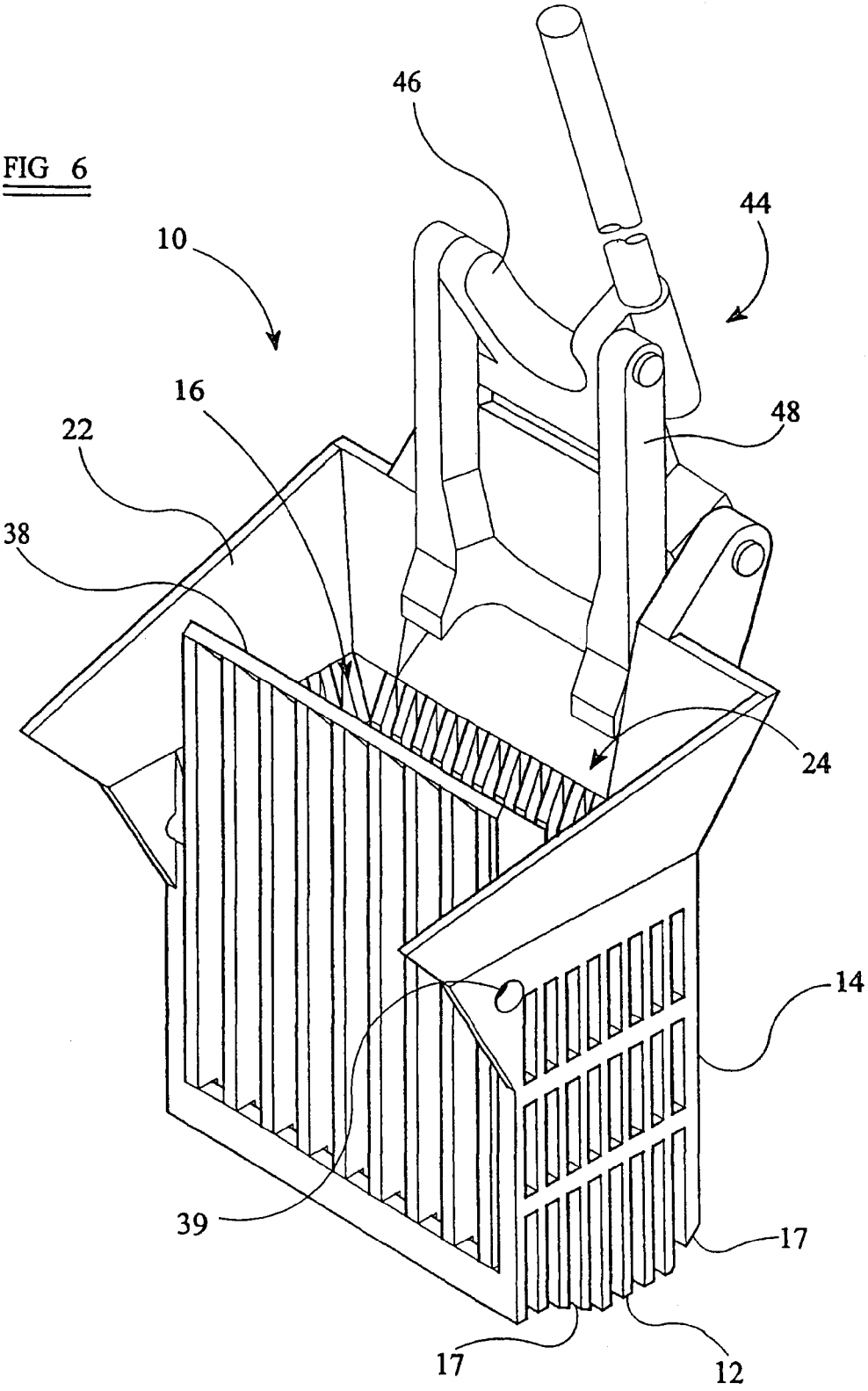
FIG. 6 shows a perspective view of a third embodiment of a mop wringer when in a first condition, in accordance with the present invention.

In a second embodiment of the wringer 10, as shown in FIG. 5, the pivotable guide element 38 may include a base portion 42 which is formed on the guide element 38, at or adjacent to its lower end. The base portion 42 typically extends at right angles to the inner surface of the guide element 38. In this case, the base 12 may be dispensed with entirely, or, as shown in FIG. 5, the base 12 may act in conjunction with the in use base portion 42 to form the bottom surface to the wringer 10.

As the mophead 28 contacts the lip portion 40 of the guide element 38, the guide element 38 will tend to pivot towards the vertical, thus forming the channel 16 with a base perpendicular to its depth.

In this embodiment, the axle elements 39 are positioned nearer to the in use lowermost edge of the guide element 38, then to the uppermost edge of the guide element 38.

In a third embodiment to the wringer 10, as shown in FIGS. 6 to 9, an elongate member 44 is pivotably mounted, typically on the guide portion 22, adjacent the opening 24 to the channel 16. The elongate member 44 comprises a first yoke element 46 formed part way therealong and a second yoke element 48 pivotably mounted adjacent the first yoke element 46.

Typically, the mophead 28 includes a bearing member (not shown) on which, once positioned, the first yoke element 46 can press. The bearing member is typically in the form of a collar which comprises a bearing surface, against which the first yoke element 46 can bear, and a sleeve. The sleeve abuts the body 30 of the mophead 28 so that the bearing surface is spaced therefrom.

Figure 7:
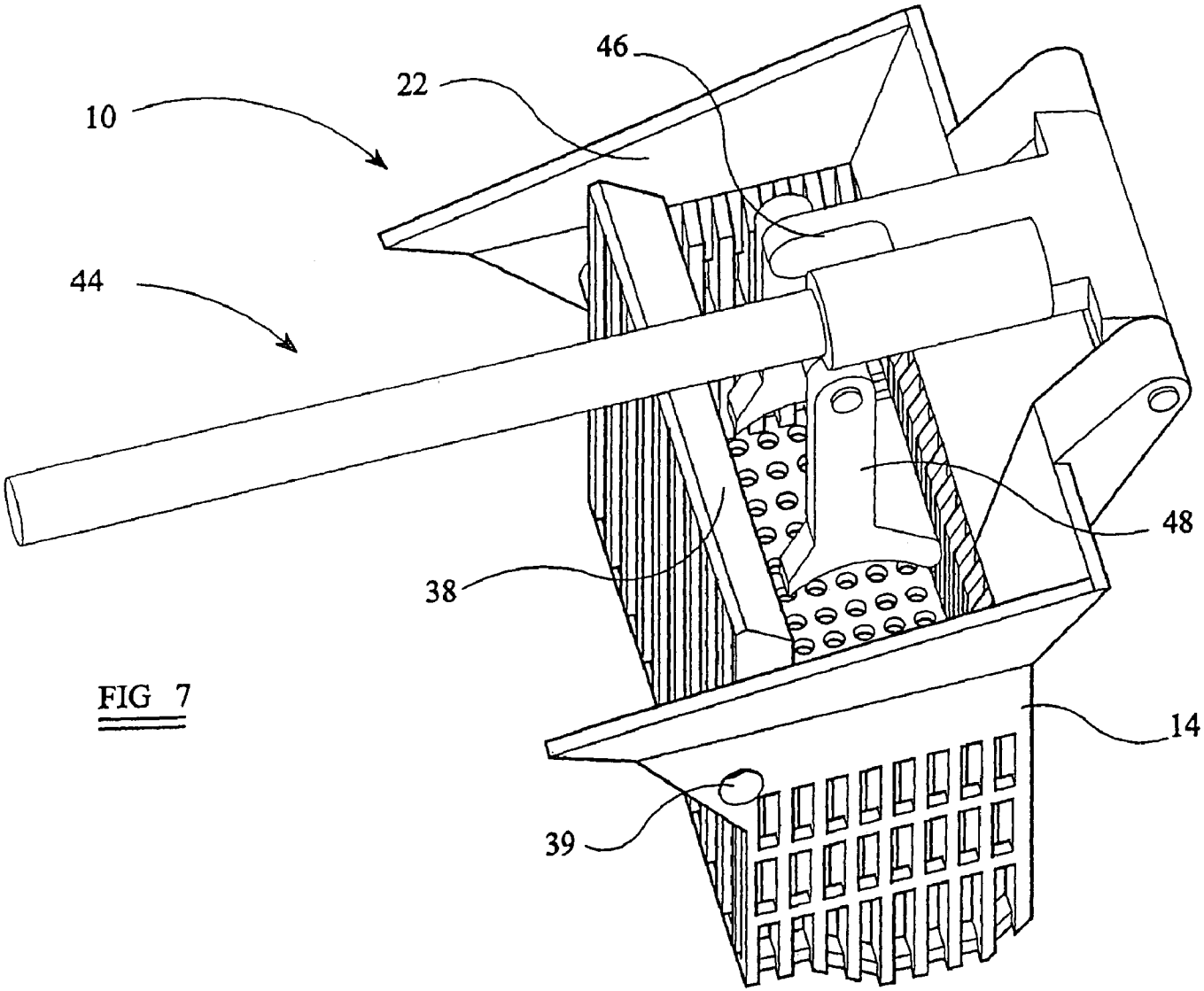
FIG. 7 shows a perspective view from above of the mop wringer shown in FIG. 6, when in a second condition.
Figure 8:
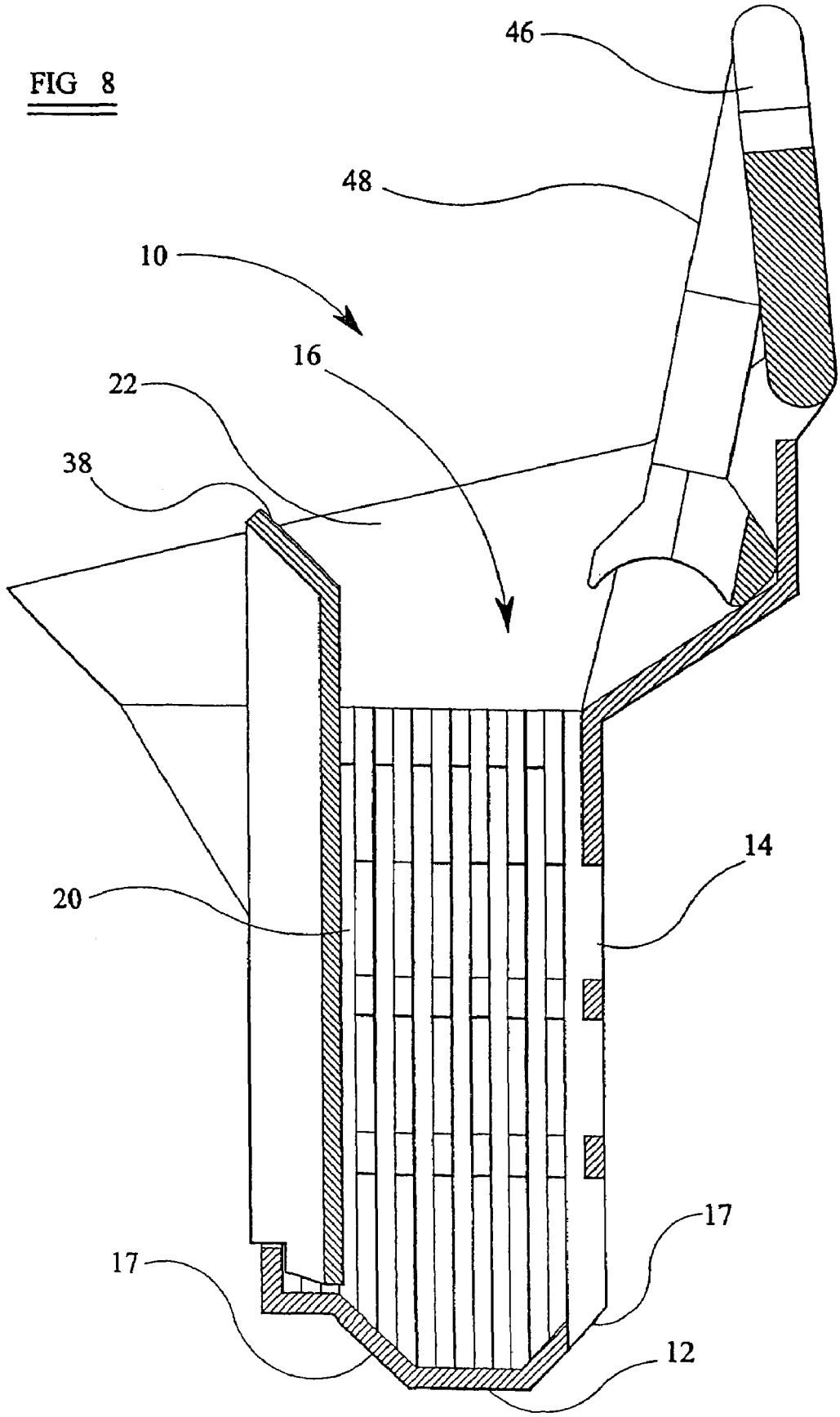
FIG. 8 is a longitudinal cross-section of the mop wringer as shown in FIG. 6.
Figure 9:
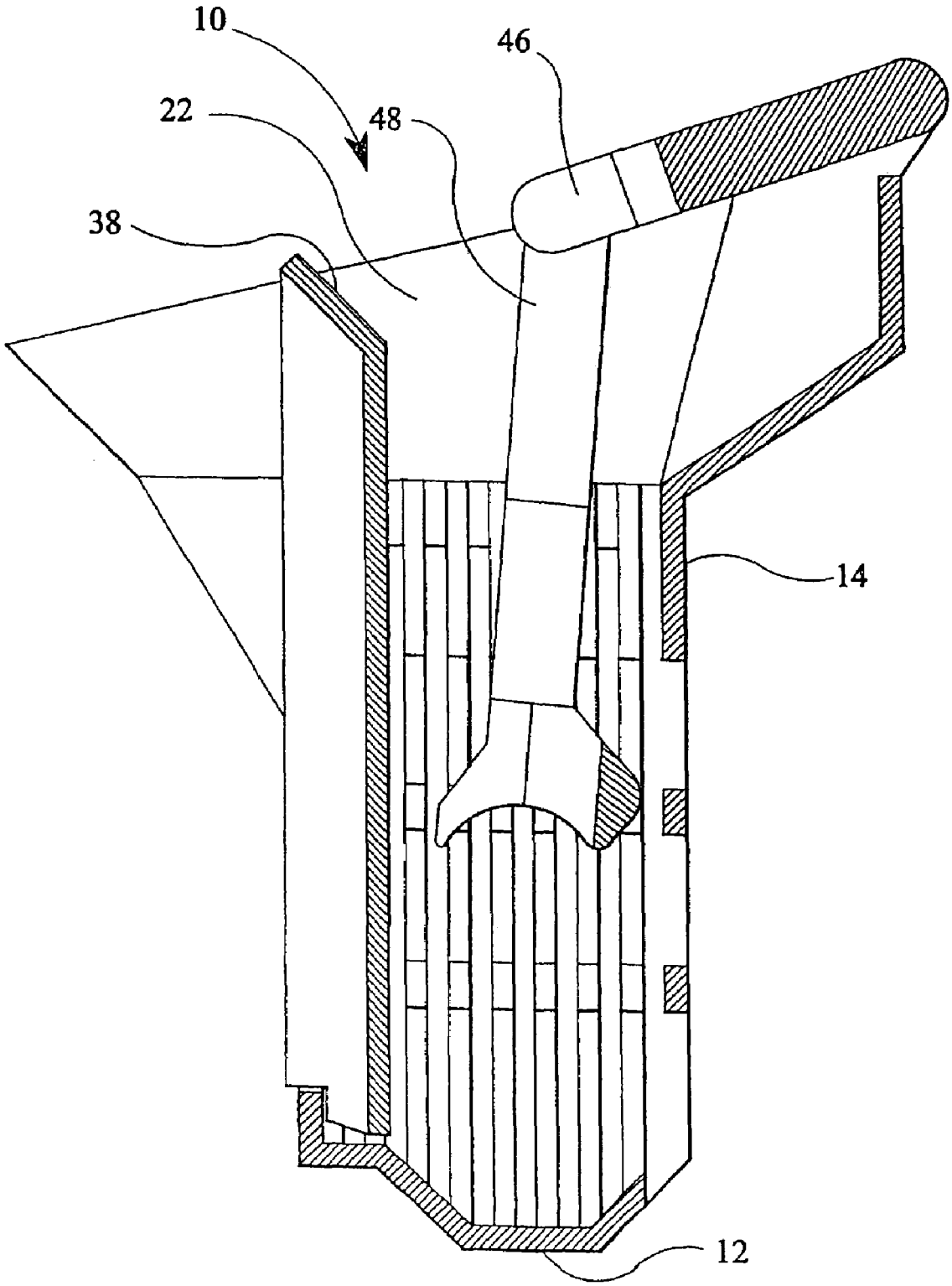
FIG. 9 is a longitudinal cross-section of the mop wringer as shown in FIG. 7.

The second yoke element 48 can be positioned (as shown in FIGS. 7 and 9) to press directly on the body 30 of the mophead 28.

The elongate member 44, when engaged with the mophead 28, acts as a lever and, in accordance with the principle of moments, enables the bundle of strands 34 to be further compressed into channel 16 and thus subjected to an increased squeezing or wringing pressure.

It should be noted, however, that the second yoke element 46 may be optional if only a mop having the bearing member is to be used, and only the second yoke element 46 need to be provided if the bearing member is not provided. In the latter case, the second yoke element 46 can be pivoted directly from the elongate member 44.

Figure 10:
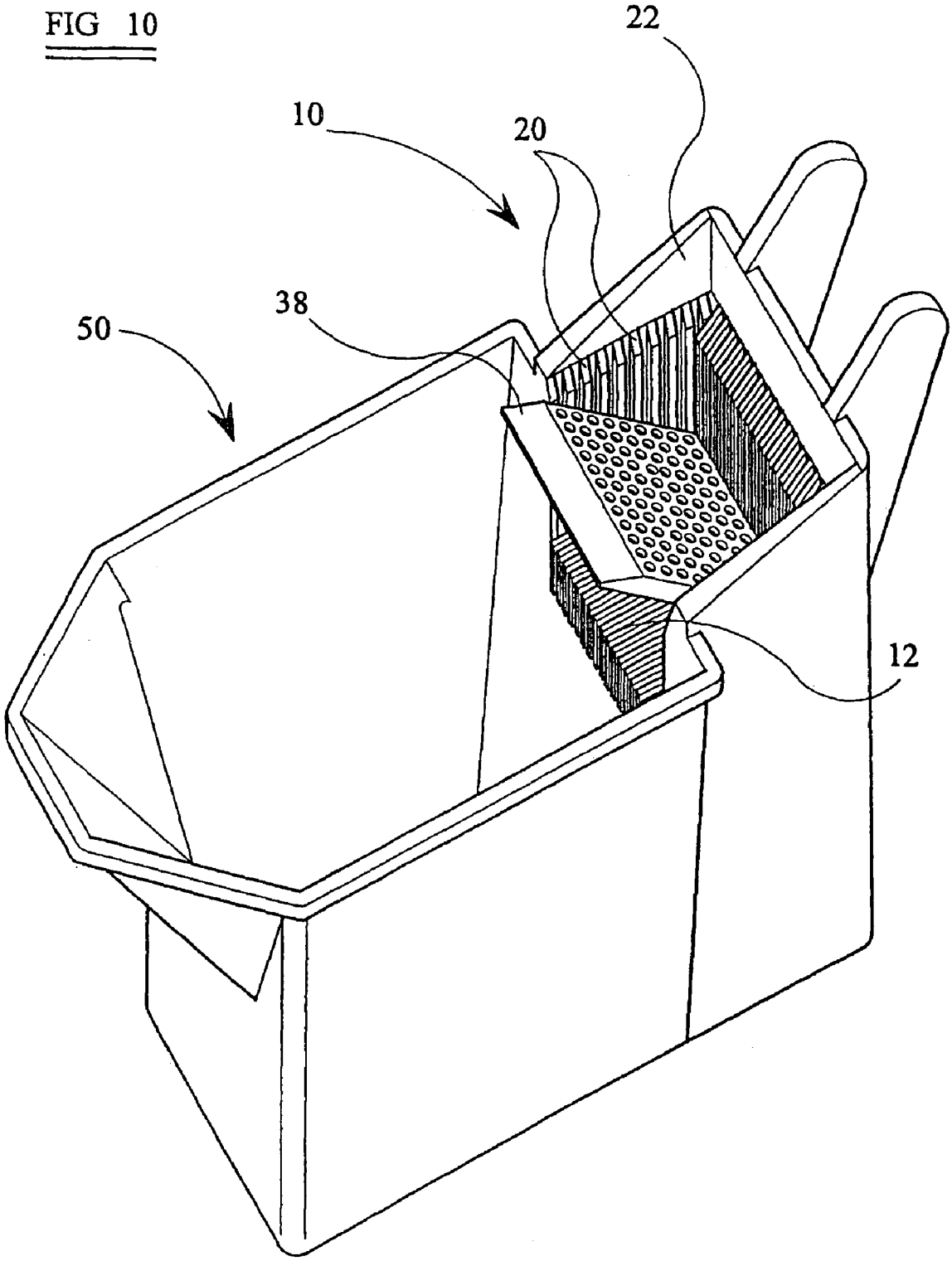
FIG. 10 is a perspective view of a fourth embodiment of a mop wringer, in accordance with the present invention.
Figure 11:
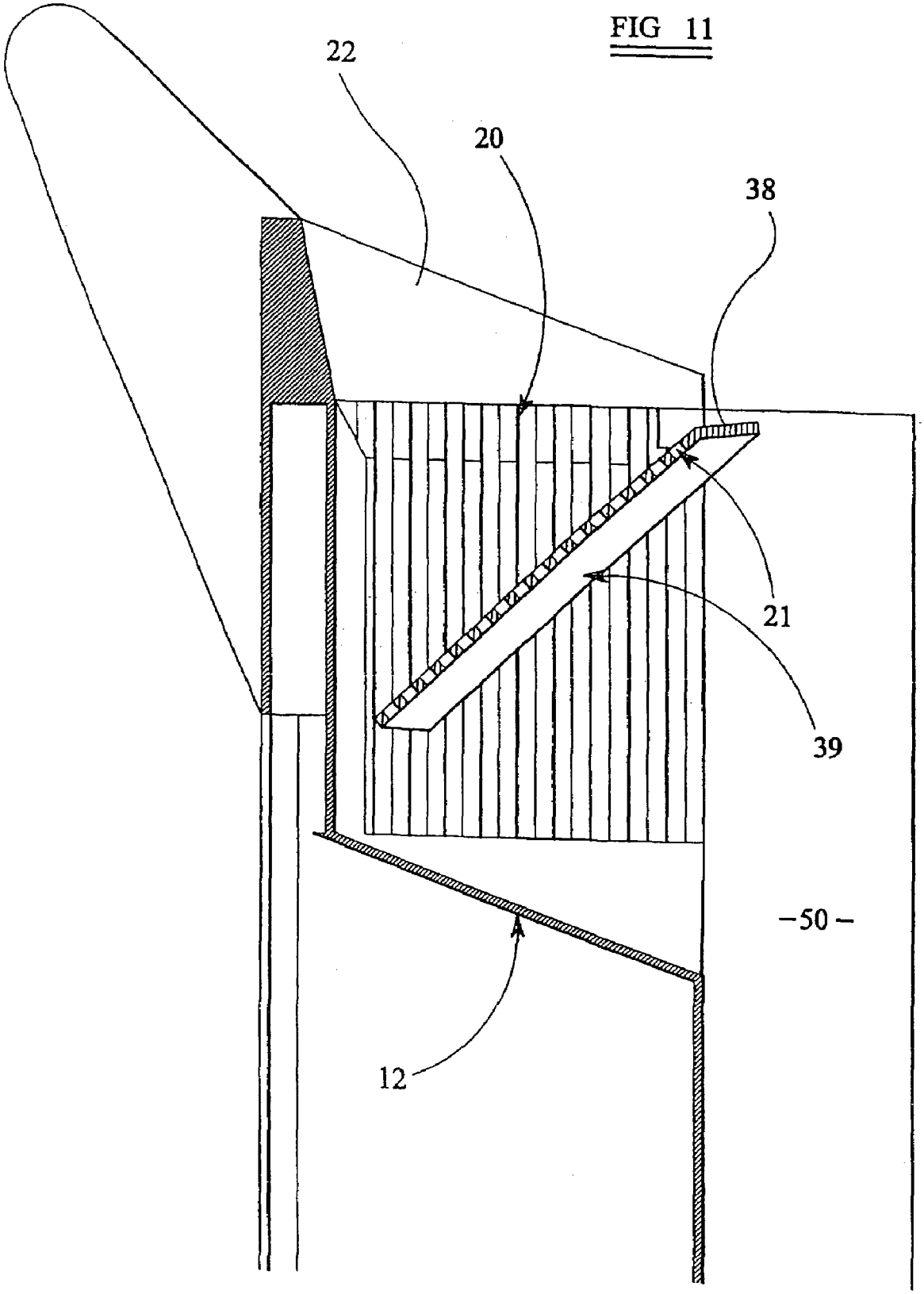
FIG. 11 is a longitudinal cross-section of the mop wringer shown in FIG. 10.

In a fourth embodiment, the wringer 10 may be integrally formed as part of the container (referenced at 50), as shown in FIGS. 10 and 11. In this case, the said attachment means can be dispensed with.

As best can be seen in FIG. 11, the base 12 in this embodiment is sloped in towards the body of the container 50 in order to promote the run-off discharged fluid into the container 50.

To provide for use of mopheads of smaller size, it is envisaged that an adapter could be inserted to restrict the transverse cross-sectional area of the channel 16 and thereby maintain the necessary average clearance of less than or equal to 12 millimetres between the sides of the channel 16 and the body of the smaller mophead.

In the first through fourth embodiments, the pivotable guide element 38 could be removable to permit the insertion of the adapter. This adapter would typically comprise one or more sides, similar to the sides 14, and its own pivotable guide element, similar to the guide element 38.

With the mop wringer and mophead combination described above, it is possible to increase the total amount of fluid expelled or discharged from absorbent material of a mophead to a container, and thereby reduce the number of squeezing or wringing operations required before the task at hand (mopping or storage) can be adequately resumed or performed:

The invention described above is given by way of example only and various modifications will be apparent to persons skilled in the art without departing from the scope of the invention. For example, the collar may not include the sleeve, in which case it is attached directly to the mop handle 36; the bearing member may be excluded altogether; and the absorbent material may be supported on the body 30 by means other than clamping.

What is claimed is:

1. A mop wringer, comprising:

a base and a plurality of sides defining a channel having a longitudinal extent with a uniform cross-section; and one or more openings in one of the base and the sides by which openings fluid can drain from the wringer, one of the said sides being a pivotable guide element which is pivotable relative to the other said sides on axle elements which are spaced from and which axle elements are between the in use uppermost and lowermost ends of the said pivotable guide element so that the guide element is angularly displaceable about an axis of the axle elements, which axis is fixed relative to the opposing sides of the channel and, so that the in use pivotable guide element provides a wider opening for insertion of a mophead into the channel, but does not pivot to squeeze the mophead.

2. A mop wringer as claimed in claim 1, wherein a distance between the lowermost end of the said pivotable guide element and the said axle elements is greater than a distance between the uppermost end of the said pivotable guide element and the said axle elements.

3. A mop wringer as claimed in claim 1, wherein a distance between the uppermost end of the said pivotable guide element and the said axle elements is greater than a distance between the lowermost end of the said pivotable guide element and the said axle elements.

4. A mop wringer as claimed in claim 1, wherein the pivotable guide element is movable by insertion of the mophead into the channel.

5. A mop wringer as claimed in claim 1, wherein the pivotable guide element includes a base portion.

6. A mop wringer as claimed in claim 5, wherein the base portion entirely forms the said base.

7. A mop wringer as claimed in claim 1, wherein the pivotable guide element is removable.

8. A mop wringer as claimed in claim 1, wherein, the axle elements are positioned at side edges of the guide element and nearer to the in use lowermost edge of the guide element than to the uppermost edge of the guide element.

9. The mop wringer of claim 1, wherein, the axle elements are positioned at side edges of the guide element and the openings are circular.

10. A mop wringer in combination with a mophead, the wringer comprising a base and a plurality of sides which, at least in use, define a channel of rectangular transverse cross-section, and one or more openings in the base and/or sides by which fluid can drain from the wringer, and the mophead comprising a body and absorbent material supported by the body, the mophead being adapted, upon insertion into the wringer, to occlude the channel so that fluid which is discharged from the absorbent material is prevented or substantially prevented from rising above the absorbent material, wherein one of the said sides is a pivotable guide element which is pivotable relative to the other said sides on axle elements which are spaced from and which are between in use uppermost and lowermost ends of the said pivotable guide element, so that the in use pivotable guide element provides a wider opening for insertion of a mophead into the channel, but does not pivot to squeeze the mophead, and wherein the axle elements are supported by opposing sides of the channel, which sides are adjacent to the pivotable guide element, so that the guide element is angularly displaceable relative to the channel about the axle elements at a position which is fixed relative to the opposing sides of the channel.

11. A mop wringer as claimed in claim 1, wherein, the axle elements are positioned at side edges of the guide element and nearer to the in use uppermost edge of the guide element than to the lowermost edge of the guide element.

12. The mop wringer of claim 10, wherein, the axle elements are positioned at side edges of the guide element and the openings are circular.

13. A mop wringer, comprising:

a channel (16) defined by a base (12) and a plurality of sides (14), the channel (16) having a transverse cross-section and a depth;

a plurality of drainage holes formed in one of the base and sides; and a guide element (38) pivotally mounted on axle elements (39) received in respective openings in opposing ones of the sides so that the guide element is pivotally angularly displaceable relative to the channel about an axis of the axle elements, which axis is fixed relative to the opposing sides of the channel, wherein, the axle elements are positioned at side edges of the guide element and nearer to an in use uppermost edge of the guide element than to a lowermost edge of the guide element.

14. The mop wringer of claim 13, wherein, the openings are completely circular.

* * * * *